United States Patent [19]

Fukuda

[11] Patent Number: 5,006,016

[45] Date of Patent: Apr. 9, 1991

[54] COROTATING PREVENTOR OF EXCAVATED SOILS IN A GROUND IMPROVEMENT APPARATUS

[75] Inventor: Kosei Fukuda, Yokohama, Japan

[73] Assignee: Tenox Corporation, Tokyo, Japan

[21] Appl. No.: 446,147

[22] Filed: Dec. 5, 1989

[30] Foreign Application Priority Data

Dec. 17, 1988 [JP] Japan ..... 63-163824[U]

[51] Int. Cl.[5] ..... E02D 5/56

[52] U.S. Cl. ..... 405/240; 405/236; 405/232; 405/267

[58] Field of Search ..... 405/266, 267, 232, 233, 405/236, 240, 241, 242; 175/252; 37/81

[56] References Cited

U.S. PATENT DOCUMENTS

| | | | |
|---|---|---|---|
| 2,782,605 | 2/1957 | Wertz et al. | 405/266 |
| 3,023,585 | 3/1962 | Liver | 405/266 |
| 4,537,536 | 8/1985 | Tsubonuma et al. | 405/267 |
| 4,793,740 | 12/1988 | Schellhorn | 405/232 |
| 4,902,172 | 2/1990 | Fukuda | 405/267 X |

*Primary Examiner*—Dennis L. Taylor
*Assistant Examiner*—J. Russell McBee
*Attorney, Agent, or Firm*—Fleit, Jacobson, Cohn, Price, Holman & Stern

[57] ABSTRACT

An excavation rod of a ground improvement apparatus is provided with an excavation blade and plural steps of agitation blades above the excavation blade. A corotation prevention blade which does not rotate during the excavation vertically and rotationally, is provided between the excavation blade and the agitation blade and plurality of downwardly projecting fingers are secured to the corotating prevention blade.

4 Claims, 2 Drawing Sheets

COROTATING PREVENTOR OF EXCAVATED SOILS IN A GROUND IMPROVEMENT APPARATUS

BACKGROUND OF THE INVENTION

This invention relates to a corotating preventor in a ground improvement apparatus for performing the agitation mixing of the ground efficiently in the ground improvement wherein soils and fillers are mechanically mixed to solidify cylindrically.

A conventional soil improvement apparatus comprises a excavation rod provided with an excavation blade at the tip end thereof and plural steps of agitation blades at the upper portions thereof, said excavation rod being allowed to excavate the soil rotatively by means of an excavating mechanism and performing the solidification of the soil by fillers such as sodium silicate or cement milk fed from a liquid passage provided within the excavation rod with reinforced agitation at low pressure at the time of the excavation or of the drawing out of the rod.

However, although such kind of soil improvement apparatus is effective to the soil such as sand soil or silt since the soil is once cut by a mixing head and the fillers are fed to the clearance between the cut soils at low pressure to mix and agitate the fillers with excavated soils, in case of a clay, particularly in a hard clay or a peat layer, the soil to be improved tends to be corotated with the agitation blades which makes it impossible to mix and agitate both cut soils and fillers effectively. As a means to solve this problem, there exist patent laid open No. 58(1983)-29374 and patent laid open No. 58(1983)-29375 developed by the same Applicants. The former technique is, as shown in FIG. 6, a mixing agitation blade apparatus for cut soils characterized in that corotating preventors 4 are positioned between an excavation blade 2 of an excavation rod 1 and an agitation blade 3 and/or between the respective agitation blades 3, the corotation preventing blade 6 having a larger diameter than the excavation diameter of the above excavation blade 2 rotatively to the excavation rod 1 by means of boss 5.

The latter patent discloses a mixing agitation blade apparatus for cut soils characterized in that a corotating prevent-or which comprises a cylindrical body having an approximately equal diameter to the excavation diameter is positioned above an excavation blade of the excavation rod, and is rotatively attached to said rod by means of a boss and arm. A resistant plate projects outwardly from the periphery of the corotating preventor body and a corotating prevention blade is extended inwardly on from the cylindrical body.

However, in the above apparatus the distance between the excavation blade 2 and the corotating prevention blade 6 may not be small enough to prevent the soil between the lower end of the corotating prevention blade 6 and of the excavation blade 2 may still adhere to the excavation blade 2 which causes the corotation. This trend is particularly evident in a ground having a very strong adhesion such as hard clay and the like.

SUMMARY OF THE INVENTION

This invention provides a corotating preventor which makes it possible to prevent the corotation of the cut soil near the excavation blade.

In order to achieve the above object, this invention is characterized in that a ground amendment apparatus having an excavation rod with an excavation blade at the tip end thereof and an agitation blade and a corotating prevention blade between the excavation blade and agitation blade is provided with plural projecting fingers extended downwardly from the corotation preventing blade between the excavation blade and the prevention blade.

Although lumps of soil excavated by the excavation blade may corotate integrally with the excavation blade at first, the rotation thereof is stopped by the projecting fingers to separate the soil from the excavation blade. Accordingly, since the lumps of the soil do not adhere to the excavation blade, the excavation can be performed smoothly together with an efficacious mixing and agitation of the soils.

DETAILED DESCRIPTION OF THE INVENTION

Figure 1:
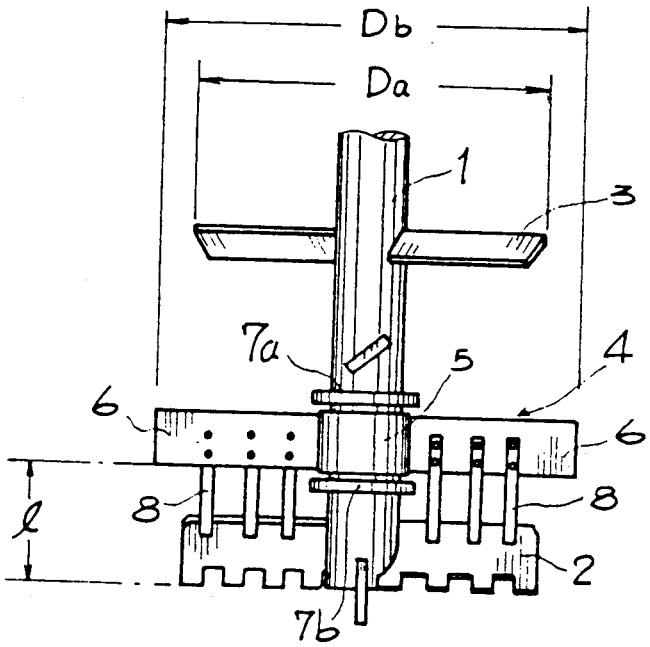
FIG. 1 is a front view which shows an example of this invention.
Figure 2:
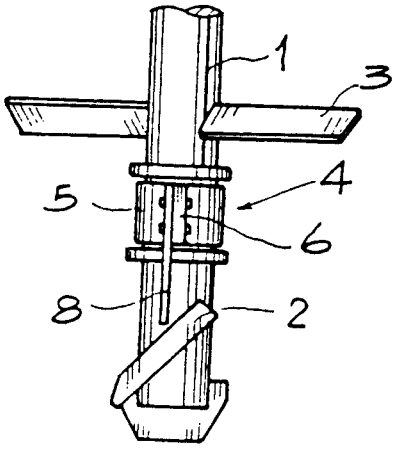
FIG. 2 is side view of the same example.
Figure 6:
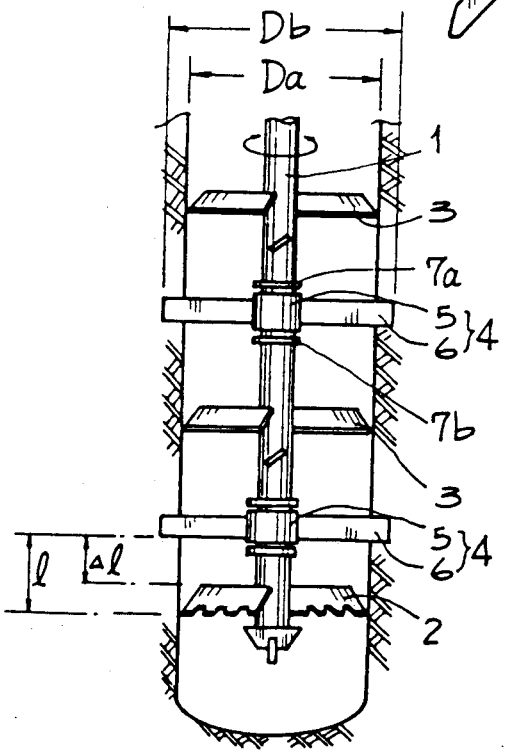
FIG. 6 is a front view of the known apparatus.

FIG. 1 and FIG. 2 shown only the improved parts of the apparatus at a tip end of portion of the excavation rod 1 because the fundamental constitution of the ground improvement apparatus of this invention is approximately the same as the conventional one as shown in FIG. 6. In other words, FIG. 1 and FIG. 2 only represent the tip end portion of the excavation rod 1. The excavation rod 1, has an excavation blade 2 with a fixed excavation diameter Da and agitation wings 3 having approximately the same diameter as the excavation blade 2 positioned above the excavation blade 2 in plural steps, only one wing 3 being shown.

A corotating preventor 4 having a larger diameter Db than the excavation diameter Da is inserted between the excavation blade 2 of the excavation rod 1 and the agitation wing 3, and a further such preventor (not shown) may be inserted between the upper and lower agitation wings 3, in a rotative state against the excavation rod.

The corotating prevention 4 is, as shown in FIG. 1, constituted by fixing two corotating prevention blades 6, to a sleeve-like boss 5 loosely attached to the excavation rod 1, said diameter of the corotating prevention blades providing projection of the rod into soil without causing rotation thereof when the excavation rod 1 rotates, since the outer diameter Db of the corotating prevention blades is larger than the diameter Ds of the excavation.

Further, the corotating prevention blades 6 may comprise more than three plates fixed to the boss 5. Furthermore, bosses 7*a* and 7*b* are fixed to the excavation rod 1 above and below the boss 5 so that the corotation preventor 4 may not vertically move more than a fixed interval along the excavation rod 1 during the excavation or drawing out of the excavation rod 1.

A plurality of projecting fingers 8 consisting of spring plate or spring bar which project downwardly are secured to the corotating prevention blade 6 positioned between the excavation blade 2 and the agitation blade 3. The length of the projecting pieces is such that the lower ends thereof may be contacted by the excavation blade 2.

When the excavation rod I rotatively excavates the soil by means of a fixed drive mechanism, an excavation hole having an excavation diameter Da is formed in the soil. In this case, the corotating preventor 4 having a larger diameter Db than the excavation diameter Da is propelled downwardly through the soil during the excavation without rotation.

Figure 3:
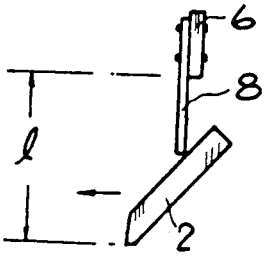
FIG. 3(*a*)-(d) are explanatory views showing operation of the same apparatus.
Figure 3:
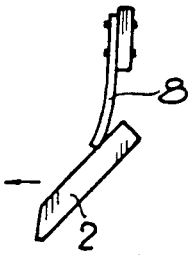
Figure 3:
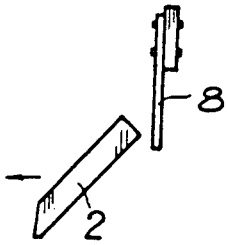
Figure 3:
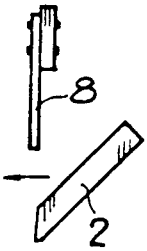

When the soil is very adhesive, though the lumps of soil (soil lumps within the range shown in FIG. 1) excavated by the top end of the excavation blade 2 corotate integrally with the excavation blade 2 at first, the rotation thereof is stopped by the projecting fingers 8 secured to the corotating prevention 6 as shown in FIG. 3 (*a*) to (*d*), thereby being separated from the excavation blade 2. Accordingly, the soil is mixed and agitated efficiently. Further, since the projecting pieces 8 are elastic, no damage occurs by contact with excavation blade 2.

Figure 4:
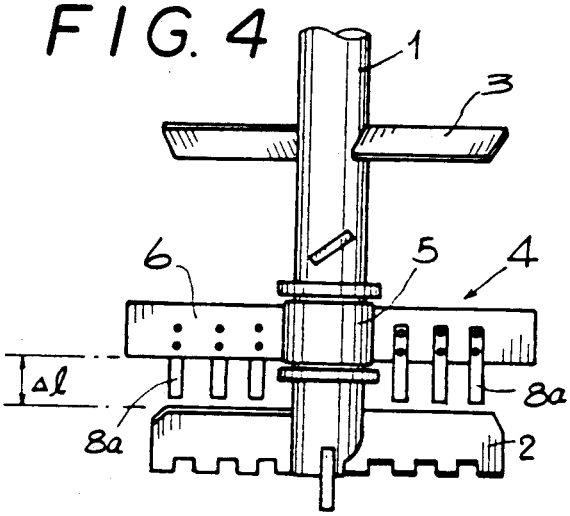
FIG. 4 is front view which shows an another example of this invention.
Figure 5:
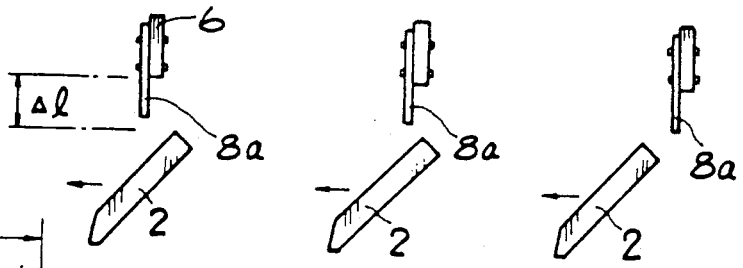
FIG. 5 (*a*) to (*c*) are explanatory views showing operation of the same.

FIG. 4 and FIG. 5 show another embodiment of the invention wherein the projecting FIGS. 8*a* secured to the corotating prevention blade 6 are shorter than the first embodiment so as not to contact with the excavation blade 2. Accordingly, the projecting pieces 8*a* in this case need not be elastic. According to this example, the soil within the range from the upper end of the excavation blade 2 to the lower end of the corotating prevention blade 6 is prevented from corotation.

The invention is not limited to the above examples. For instance, it is applicable to the technique wherein the corotating prevention blade is secured to the inner circumference of a cylindrical body as described in the patent laid open No. 58(1983)-2937.

As described above, according to this invention, the corotation of the cut soil adhered to the excavation blade can be prevented, thereby to increase the efficiency of the mixing and agitation of the soil.

I claim:

1. A ground improvement device comprising an excavation shaft having an excavation blade fixed to a tip end of the shaft, at least one agitation blade fixed on the shaft, and at least one radially extending corotation preventing blade rotatably mounted on the shaft, the corotation blade having a diameter greater than that of the excavation blade, and a plurality of radially spaced fingers extending from the corotation blade substantially in an axial direction towards the excavation blade.

2. A device according to claim 1 wherein the corotation blade is located between the agitation blade and the excavation blade.

3. A device according to claim 2 wherein the fingers are resilient and engage the excavation blade.

4. A device according to claim 2 wherein there is clearance between the fingers and the excavation blade.

* * * * *